United States Patent [19]

Cahill

[11] 3,942,309

[45] Mar. 9, 1976

[54] METHOD OF AND APPARATUS FOR MAKING WIRE STRAND

[75] Inventor: Terence Cahill, Porthcawl, Wales

[73] Assignee: GKN Somerset Wire Limited, Cardiff, Wales

[22] Filed: June 18, 1974

[21] Appl. No.: 480,925

[52] U.S. Cl. ..... 57/9; 57/14; 57/145; 57/166

[51] Int. Cl.[2] ..... D07B 3/00; D02J 3/00

[58] Field of Search ..... 57/3, 6, 9, 34 R, 55, 138, 57/161, 166, 13, 14, 15, 58, 49, 52, 139, 144, 145, 148, 156, 160

[56] References Cited

UNITED STATES PATENTS

| | | | |
|---|---|---|---|
| 1,866,272 | 7/1932 | Seeley | 57/58.52 |
| 3,083,817 | 4/1963 | Campbell | 57/161 |
| 3,293,837 | 12/1966 | Vennett | 57/15 X |
| 3,444,684 | 5/1969 | Schoerner | 57/161 |
| 3,448,569 | 6/1969 | Brown et al. | 57/15 |
| 3,823,543 | 7/1974 | Glushko et al. | 57/166 |

*Primary Examiner*—Donald E. Watkins
*Attorney, Agent, or Firm*—Spencer & Kaye

[57] ABSTRACT

A method of making compacted steel wire strand having a central core wire and at least one layer of wires wound around the core wire in which uncompacted strand is made by pulling the wires through a closing die and the wire is then compacted in not more than two reducing dies the dies being arranged so that the wires forming the strand are free to move relative to one another to prevent birdcaging during the reduction in area of the strand to compact it.

7 Claims, 4 Drawing Figures

METHOD OF AND APPARATUS FOR MAKING WIRE STRAND

BACKGROUND OF THE INVENTION

1. Field of the Invention

This invention relates to steel wire strand of the kind, hereinafter called "the kind specified", comprising a central core wire and at least one layer of wires wound around the core and the invention is concerned in particular with a method of and apparatus for making such strand.

2. Description of the Prior Art

Steel wire strand of the kind specified is normally made by laying up a plurality of wires of round, i.e. circular, cross section so as to form a strand by advancing through a closing die the individual wires from wire-carrying bobbins supported for rotation within a cage itself supported for rotation about the longitudinal axis of the closing die, the resultant strand having a cross section which is circumscribed by a circle.

In such known practice the rotation of the individual bobbins is braked merely to the extent necessary to keep the individual wires taut upstream of the closing die.

It is also known to treat the strand so produced to compact it, i.e. to deform the individual wires from their circular cross section and thus to obtain a strand with a higher fill factor than that of the uncompacted strand. (The fill factor is the percentage of the area of a circle circumscribing the section of the strand which is filled by metal). Steel wire strand is used, inter alia, for prestressing tendons in concrete structures and in some applications where space for the tendons is limited it is desired to have as much metal as possible in a given cross-sectional area so that compacted strand is then preferred to uncompacted, round-wire strand.

The present commercially used method of making compacted steel wire strand comprises drawing a length of the already formed wire strand (see U.S. Pat. No. 3,083,817) of the kind specified and which is uncompacted and in which the wires have a round cross section, through a reducing die so as simultaneously to consolidate and reduce the cross section of the strand with consequent deformation of the wires with the assistance of a specially applied back tension to the strand during the passage of the strand through the reducing die.

If one draws round-wire strand of the kind specified from a reel through a reducing die without special precautions, "bird-caging", takes place, that is to say in front of the die the outer wires lift away from the core wire and form a "birdcage". This happens because, during drawing, the outer wires have their cross-sectional areas reduced to a greater extent than the core wire. As drawing commences the outer wires go slack on the core wire upstream of the die and this slackness goes back to the reel. On the reel, however, the strand is effectively clamped due to the turns of the strand on the reel so that relative movement of the wires of the strand is not possible in the turns. As drawing proceeds, therefore, the elongation of the outer wires relative to the core wire causes bird-caging in front of the die. It is for this reason that back tension is applied to the strand, the back tension being sufficient at least plastically to elongate the core wire so that elongation of the core wire and the outer wires are the same. As normally carried out the method includes the application of a back tension sufficient to elongate not only the core wire but also the outer wires.

The back tension is normally provided by a braked capstan or drum around which the strand is advanced without slip before passing to the reducing die. Obviously the haul-off capstan to pull the strand through the die must be extremely powerful to overcome both the back tension and the drawing resistance.

The foregoing requirements for carefully controlled back tension necessitates the provision of sophisticated, powerful and relatively expensive equipment. We have now found, surprisingly, that it is possible to form compacted strand of the kind specified without applying more back tension than is normally used during the formation of uncompacted strand.

The present invention has for its object the provision of a method and apparatus for producing compacted strand of the kind specified by which it is believed that a substantial saving in plant costs and a significant saving in skilled labour costs can be effected and without any likelihood of the above mentioned tendency to bird-caging arising.

SUMMARY OF THE INVENTION

According to one aspect of this invention, we provide a method of making compacted steel wire strand comprising a central core wire and at least one layer of wires wound around the core wire comprising the steps of:

a. advancing to a closing die a plurality of separate strand forming steel wires each of round, i.e. circular form in cross section, each wire being advanced from a separate rotatable bobbin, b. braking the rotation of the bobbins to an extent so as merely to maintain the wires taut so that no plastic flow of the wire takes place, between the bobbins and the die, c. by said closing die assembling the separate round section wires into uncompacted strand, comprising a central core wire and at least one layer of wires wound around the core wire without substantially changing the cross-sectional shapes or sizes of the wires, and d. advancing the strand emerging from the closing die through a reducing die to deform to non-circular section at least the outer wires of the strand and to reduce the cross-sectional area of such wires, thus increasing the fill factor of the strand, the reducing die consisting of two spaced-apart die elements between which the strand is lubricated the percentage reduction in cross-sectional area of the strand in the or each die element being not less than 10%, e. the method being such that the wires forming the strand are free to move relative to one another in the directions of their lengths throughout their passage from the bobbins to their exit from the reducing die through distances corresponding to the differences in length of the individual wires caused by drawing the strand through the reducing die thus to prevent bird-caging.

In the performance of the foregoing method, a conventional form of stranding machine is employed in which the individual wires are supplied from the usual bobbins, the rotation of which in relation to the cage of the stranding machine is as is normal in the manufacture of uncompacted strand of the kind specified, restrained merely to the extent necessary to maintain the wires taut as they enter the closing die.

In particular, no back tension is applied to any of the strand-forming wires so as thereby to effect any plastic elongation thereof upstream of the reducing die such as to reduce, in the case of the outer wires, the radial load on the die being used to compact the strand. The greater the radial load mentioned above the greater degree of compaction, but if back tension is applied which causes the outer wires to flow longitudinally upstream of the die this longitudinal movement is at the expense of the desired lateral movement required to fill in the voids between the wires. Thus the elimination of back tension is in this respect considered advantageous and it is surprising, in view of the generally accepted belief that substantial back tension is required, that satisfactory results are obtained with the method of the invention.

It is an essential characteristic of the method just described that there is the foregoing freedom for relative movement as above specified between the individual wires in the directions of their length and this is ensured by performing the compacting step on the just formed strand as opposed to using as the starting material strand wound on a reel for the reasons explained above.

One would expect that die wear would be reduced by increasing the number of die elements used to effect the reduction in area of the strand leaving the closing die. We have found however, that increasing the number of die elements increases the value of the force required to pull the wire through the die elements and this force can increase to such an extent as to cause breakage of the strand. We have found that, in the present state of die-making technology, the optimum number of die elements is two.

The overall reduction in cross-sectional area (i.e. the area of the circumscribing circle of the strand) of the strand leaving the reducing die will normally be between 19 and 30%. That is to say the cross-sectional area of the strand leaving the exit of the reducing die will be between 19 and 30% smaller than the cross-sectional area of the strand leaving the closing die. Since the reducing die consists of two die elements the exit of the die will be the exit of the second element. We have also found that the percentage reduction of cross-sectional area in each element should not be less than 10% otherwise excessive wear of the die occurs.

As the strand is formed from circular section as opposed to pre-formed, non-circular wires, the wires, during the formation of the strand, are not torsionally twisted about their own axes, so that the resultant strand is free from residual torsional stress which, if present, results in sudden unravelling of the strand when cut to length on site with consequent difficulty and possible damage to the operator.

The invention further comprises strand of the kind specified compacted by the foregoing method, as well as rope formed from a plurality of lengths of strand produced by the foregoing method.

Tests which we have so far carried out on strand produced by the method of this invention indicate a substantial improvement in the breaking load of the strand as compared with an uncompacted strand of the same diameter and for a seven wire strand comprising a single core wire and six peripheral wires with a nominal outside diameter of the order of 0.6 inch an increase in the breaking load of at least 20%.

The above increase is an increase in breaking load rather than in breaking stress and is for the same size strand, for example, with compacted strand made by the method of this invention, having a final diameter of 0.6 inch after the reducing i.e. compacting operation, with a diameter before compaction of about 0.675 inch, the breaking load would be about 68,000 lbs. This compares very favourably with the breaking load of 0.6 inch diameter normally fully formed but uncompacted round wire strand, the wire of which is of the same composition and which has a minimum breaking load of 51,000 lbs. (average breaking load 3,000 or 4,000 lbs. above this minimum).

This increase in breaking load by at least 20% is partly due to the reduction in the area of the voids between the outer wires of the strand and the circumscribing circle of the strand section, consequential on the compacted strand having a periphery substantially nearer a true circle as compared with the peripheral shape of uncompacted strand, as well as in consequence of the filling of voids between the adjacent wires comprised in the strand. The total reduction in the area of said voids in the above example is of the order of 10% to 15%. The other part of such increase, namely, between about 5 to 10% is consequential on the additional mechanical work which has been performed on the metal during its advancement through the reducing die.

The invention further comprises apparatus for carrying out the foregoing method, comprising:

1. a stranding machine for forming individual round steel wires into uncompacted wound strand comprising a central core wire and at least one layer of wires wound around the core wire, the machine comprising rotatable bobbins for carrying the wires, a closing die for receiving the wires from the bobbins and assembling the wires into said uncompacted strand, and means capable of braking the rotation of the bobbins, only to the extent of keeping the wire taut between the bobbins and the closing die, 2. a reducing die adjacent to the closing die to receive the uncompacted strand emerging from the closing die and to deform and reduce the cross sectional area of at least the outer wires of the strand thus to increase the fill factor of the strand, the reducing die consisting of two die elements spaced apart in the direction of strand advancement, each element being arranged to effect a percentage reduction in area of at least 10%, 3. Means to lubricate the strand between the die elements, 4. means for drawing the wires off the bobbins and through the closing die and for drawing the strand through the reducing die.

5. the dies being such that the wires forming the strand are free to move relative to one another in the directions of their lengths throughout their passage from the bobbins to the exit from the reducing die through distances corresponding to the differences in length of the individual wires caused by drawing the strand through the reducing die thus to prevent birdcaging.

Each of the two reducing die elements will embody an inwardly tapered entrance throat with an angle of taper between 8° and 35°. For a reduction in cross-sectional area of the strand of 20% the angle of taper is advantageously about 24° while for a reduction in area of 10% an angle of taper of about 20° is advantageous. The above angles give the minimum die pull required to draw the strand through the die but this is not the only criterion and departures from these angles may be necessary as determined empirically. We have found it advantageous to effect equal percentage reductions in the cross sectional area of the circumscribing circle corresponding to the overall diameter of the strand in the two elements.

For the successful performance of the invention, we have further found it necessary to form the leading end portion of each of the wires, including the core wire, of reduced cross section, preferably terminating in a pointed extremity. Such reduced cross section enables the several wires readily to be threaded successively through the closing die and the reducing die elements at the commencement of the formation of a length of strand. To facilitate the foregoing, the overall length of the reduced section end portion of each wire would be made greater than the spacing of the die elements.

For instance, in our experiments to date, the end portion of each wire has been reduced by first drawing through a small die so that we have 20 feet or so of parallel wire of a reduced section terminating in a conical extremity of length of about 0.1 inch.

The invention will now be described by way of example with reference to the accompanying drawings, in which:

DESCRIPTION OF PREFERRED EMBODIMENTS

Figure 2:
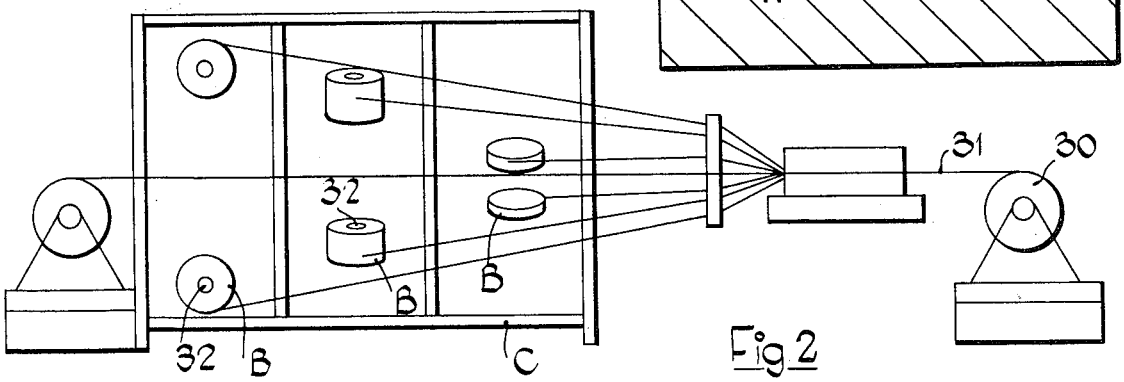
FIGS. 1 and 2 are diagrams illustrating the conventional arrangements of bobbins cage which may be employed in carrying out the invention.
Figure 1:
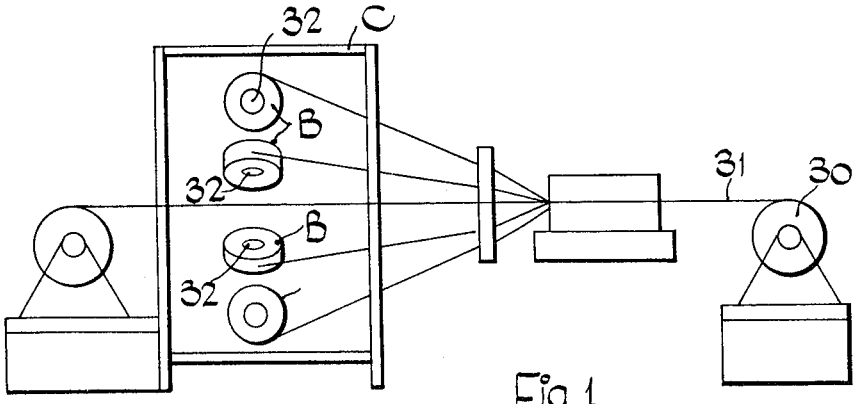

Apparatus for carrying the invention into effect comprises an elongated frame 10, one end of which is connected to a stranding machine which may be of the form diagrammatically shown in FIG. 1 or FIG. 2. This stranding machine is of the known type and may comprise either a 'sun and planet' type of machine shown in FIG. 1 in which the usual rotating cage C supports the rotatable wire-carrying bobbins B at positions spaced from the central axis of rotation of the cage so that the bobbins rotate planet-fashion about such axis, or the stranding machine may be of known tubular type shown in FIG. 2 in which the wire carrying bobbins B are mounted in a cage C in axially spaced relationship for rotation about the central axis, i.e. the axis of rotation of the cage.

Figure 3:
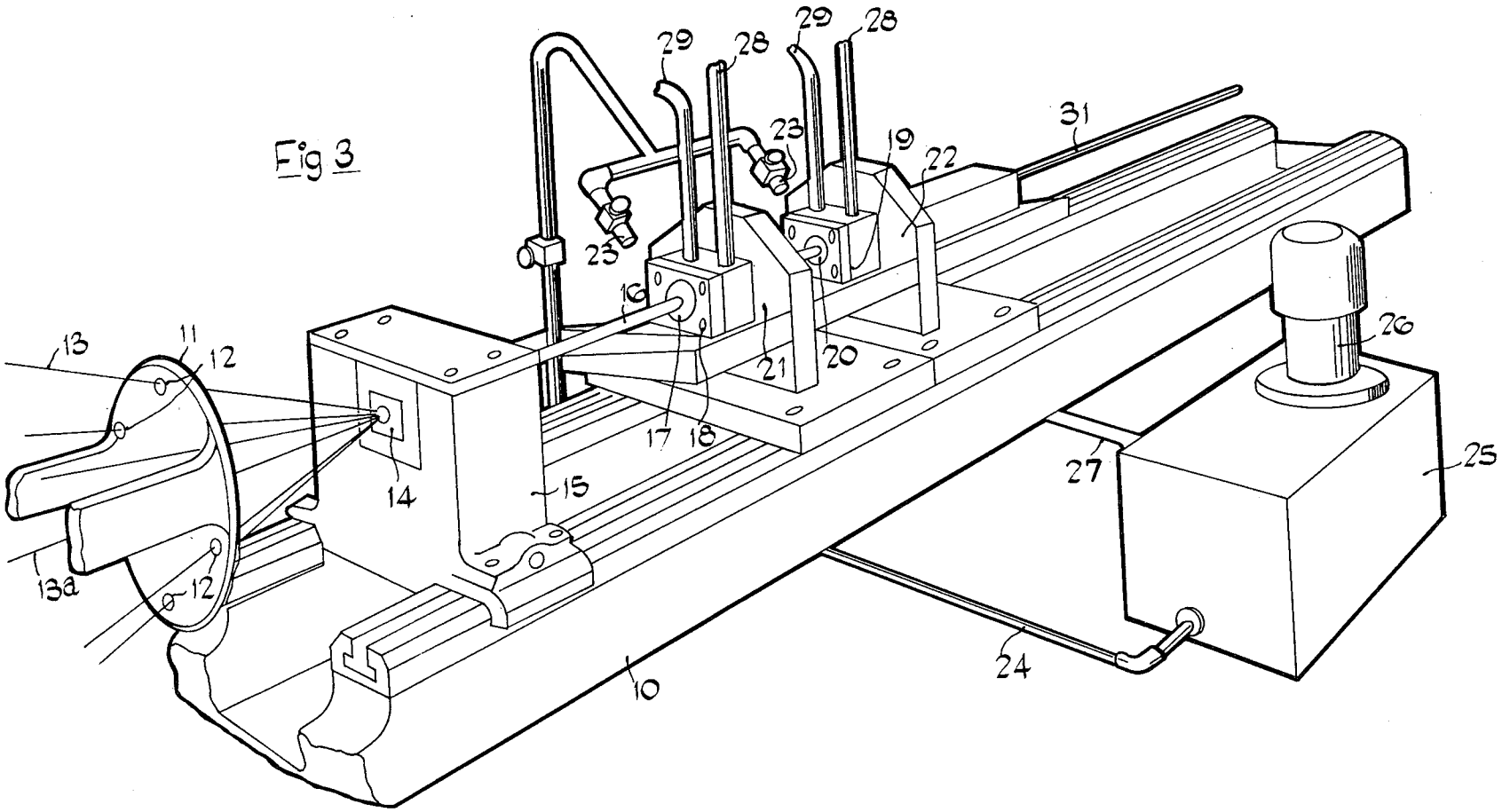
FIG. 3 is a perspective view of the arrangement of closing die and reducing die elements in apparatus embodying the invention.

As will be seen from FIG. 3, the stranding machine is provided with the usual lay plate 11 which rotates with the cage C and which is provided with the usual holes 12 for the passage of the individual wires 13 from the bobbins B to the usual closing die 14 mounted on stationary die support 15 carried on frame 10. Thus the lay plate 11 rotates relative to the non-rotating closing die 14, thus in the known way winding the several wires 13 around the central or core wire 13*a* in a helical fashion to form the uncompacted strand 16.

The just-wound strand is now advanced through a first of the reducing die elements, namely, die 17 mounted within cooling jacket 18 supported on die support 21 and appropriately spaced in the direction of strand advancement from closing die 14.

A second reducing die element 20 is similarly mounted, within cooling jacket 19 supported on die support 22 and appropriately spaced in the direction of strand advancement from the first die element 17.

The two die supports 21 and 22, together with their respective die elements, are supported from frame 10. The strand is lubricated before entering each die element by means of a lubricant stream supplied through valved supply nozzles 23 to which the lubricant is fed through pipe 24 from lubricant supply tank 25 by means of pump 26, into which tank 25 the lubricant is recirculated through return pipe 27.

The valved supply nozzles 23 may be single or multi-head arrangements and are arranged such that the lubricant is fed simultaneously onto the advancing strand and into the throats of dies 17 and 20.

Cooling jackets 18 and 19 are supplied with a fast flowing stream of water via supply pipes 28 and returned via return pipes 29.

A conventional haul off capstan 30, FIGS. 1 and 2, is provided for applying the necessary drawing force to the compacted strand 31 for drawing the uncompacted strand 16 through the two die elements 17 and 20 and thus advancing the wires from the bobbins of the stranding machine.

In operation of the apparatus, wire is drawn off the bobbins B as the cage C rotates. The outer wires 13 pass through the holes 12 in the lay plate 11 and the core wire 13*a* passes through a central aperture in the lay plate. The bobbins B are provided with conventional braking means indicated generally at 32. These braking means are only capable of retarding the rotation of the bobbins to such an extent as to retain the wires taut between the bobbins and the lay plate. The brakes are not capable of exerting so much back tension on the wires as to cause plastic elongation in the wires upstream of the closing die or reducing die elements.

The diameter of the closing die is such as merely to assemble the wires 13 and 13*a* together to form uncompacted strand without effecting any substantial compaction or deformation of the individual wires from their initial round cross section. Indeed, the closing die is usually dimensioned to have some clearance with respect to the circumscribing circle of the uncompacted strand 16. It will be appreciated from the foregoing that up to the formation of the uncompacted strand 16 the method is conventional. The uncompacted strand now passes through the two die elements 17 and 20 each of which effects a reduction in cross-sectional area of at least 10%, the overall reduction being between 19 and 30%. These die elements compact the strand, increasing the fill factor thereof and deforming at least the outer wires of the strand into keystone shape. The strand is lubricated from the nozzles 23 before entering either of the die elements 17 and 20. A high pressure lubricant is required, there being a tendency for the lubricant to be scraped off into the voids between the wires as the strand is compacted.

Upon the passage of the strand through the die element 17, the outer wires 13 will elongate relative to the core wire 13*a*. The wires can, however, move relative to one another in the directions of their lengths through the closing die 14 and the lay plate 11 with the result that less wire will be taken from the bobbins B carrying the outer wires 13, due to elongation of the outer wires, than if the strand had not been compacted. Similarly, further elongation of at least the outer wires will be effected by the die element 20 and the wires can move relative to one another through the die element 17 and closing die 14 to again reduce the length of the wire taken from the bobbins holding the outer wires 13 as compared to what would be taken were the strand not compacted.

Figure 4:
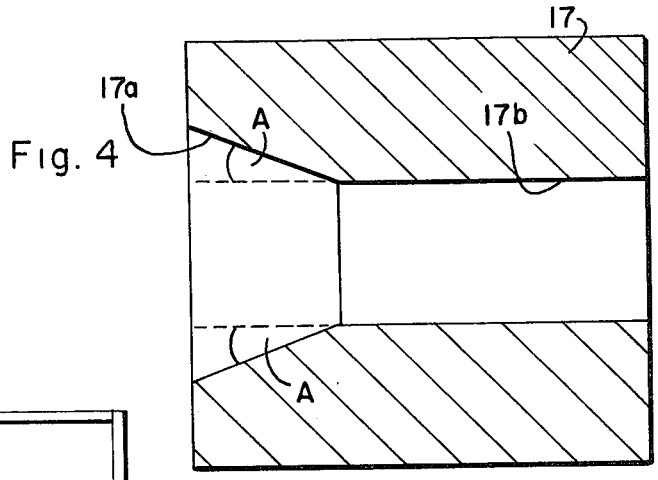
FIG. 4 is a sectional view through a reducing die element illustrating the angle of the tapered entrance throat.

FIG. 4 is a cross-section through the die element 17; a cross-section through the die element 20 would be similar. It will be seen that the die element 17 has a tapered entrance throat 17*a* and a parallel sided exit portion 17*b*. The angle of taper of the entrance throat is indicated by the angle A and this angle may, as described above, be between 8° and 35°.

This possibility of relative movement prevents bird-caging in front of either of the die elements 17 and 20. Bird-caging is prevented because any elongation of one wire relative to another can be accommodated by the difference in lengths of the wires drawn from the appropriate bobbins B. This is to be compared with the example given above of the conventional process where strand is drawn from a reel for compaction and although relative movement can take place between the wires from the reducing die to the reel, relative movement cannot take place between the wires on the reel thus resulting in bird-caging due to the elongation of the outer wires as the drawing continues.

It will be seen that the invention provides a simple method of forming compacted strand which does not require expensive or sophisticated apparatus. The invention also provides a simple apparatus for making compacted strand.

I claim:

1. A method of making compacted steel wire strand comprising a central core wire and at least one layer of wires wound around the core wire comprising the steps of:

a. advancing to a closing die a plurality of separate strand forming steel wires each of round, i.e. circular form in cross-section, each wire being advanced from a separate rotatable bobbin, b. braking the rotation of the bobbins to an extent so as merely to maintain the wires taut so that no plastic flow of the wires takes place between the bobbins and the die, c. by said closing die assembling the separate round section wires into uncompacted strand, comprising a central core wire and at least one layer of wires wound around the core wire, without substantially changing the cross-sectional shapes or sizes of the wires, and d. advancing the strand emerging from the closing die through a reducing die to deform to non-circular section at least the outer wires of the strand and to reduce the cross-sectional area of such wires, thus increasing the fill factor of the strand, the reducing die consisting of two spaced-apart die elements between which the strand is lubricated, the percentage reduction in cross-sectional area of the strand in each die element being not less than 10%, e. the method being such that the wires forming the strand are free to move relative to one another in the directions of their lengths throughout their passage from the bobbins to their exit from the reducing die through distances corresponding to the differences in length of the individual wires caused by drawing the strand through the reducing die thus to prevent bird-caging.

2. A method according to claim 1 wherein equal percentage reductions in cross-sectional area are made in each of the two die elements.

3. Compacted strand comprising a central core wire and at least one layer of wires wound around the core wire and made by the method as claimed in claim 1.

4. Wire rope formed from a plurality of lengths of strand as claimed in claim 3.

5. Apparatus for making compacted strand comprising a central core wire and at least one layer of wires wound around the core wire comprising:

1. a stranding machine for forming individual round steel wires into uncompacted wound strand, comprising a central core wire and at least one layer of wires wound around the core wire, the machine comprising rotatable bobbins for carrying the wires, a closing die for receiving the wires from the bobbins and assembling the wires into said uncompacted strand, and means capable of braking the rotation of the bobbins, only to the extent of keeping the wires taut between the bobbins and closing die,

2. a reducing die adjacent to the closing die to receive the uncompacted strand emerging from the closing die and to deform and reduce the cross-section area of at least the outer wires of the strand thus to increase the fill factor of the strand, the reducing die consisting of two die elements spaced apart in the direction of strand advancement, each element being arranged to effect a percentage reduction in area of at least 10%.

3. means to lubricate the strand between the die elements,

4. means for drawing the wires off the bobbins and through the closing die and for drawing the strand through the reducing die,

5. the dies being such that the wires forming the strand are free to move relative to one another in the directions of their lengths throughout their passage from the bobbins to the exit from the reducing die through distances corresponding to the differences in length of the individual wires caused by drawing the strand through the reducing die thus to prevent bird-caging.

6. Apparatus according to claim 5 wherein each die element is arranged to produce an equal percentage reduction in cross-sectional area of the strand entering the element.

7. Apparatus according to claim 5 wherein the or each reducing die element has an entrance throat with an angle of taper between 8° and 35°.

* * * * *